US011708968B2

(12) United States Patent
de Kreij

(10) Patent No.: US 11,708,968 B2
(45) Date of Patent: Jul. 25, 2023

(54) TWO-PART HEATSINK FOR LED MODULE

(71) Applicant: LUMILEDS LLC, San Jose, CA (US)

(72) Inventor: Danny Bastiaan Johannes de Kreij, Kerkrade (NL)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 17/738,709

(22) Filed: May 6, 2022

(65) Prior Publication Data

US 2022/0357029 A1 Nov. 10, 2022

Related U.S. Application Data

(60) Provisional application No. 63/185,767, filed on May 7, 2021.

(51) Int. Cl.

| | |
|---|---|
| ***F21V 29/70*** | (2015.01) |
| ***F21V 29/503*** | (2015.01) |
| ***F21V 19/00*** | (2006.01) |
| ***F21V 23/06*** | (2006.01) |
| *F21Y 115/10* | (2016.01) |

(52) U.S. Cl.

CPC ..... *F21V 29/70* (2015.01); *F21V 19/003* (2013.01); *F21V 19/0025* (2013.01); *F21V 23/06* (2013.01); *F21V 29/503* (2015.01); *F21Y 2115/10* (2016.08)

(58) Field of Classification Search

CPC .... F21V 29/70; F21V 29/503; F21V 19/0025; F21V 19/003; F21V 23/06; F21Y 2115/10

See application file for complete search history.

(56) References Cited

U.S. PATENT DOCUMENTS

| | | | | |
|---|---|---|---|---|
| 8,476,645 | B2 | 7/2013 | McDaniel et al. | |
| 8,567,987 | B2 | 10/2013 | Wronski | |
| 10,914,539 | B2 | 2/2021 | Tessnow | |
| 2009/0219732 | A1 * | 9/2009 | Gingrich, III | G02B 6/4298 362/555 |
| 2015/0146422 | A1 * | 5/2015 | Kwak | F21V 31/005 362/235 |
| 2017/0009954 | A1 | 1/2017 | Ueno et al. | |

(Continued)

FOREIGN PATENT DOCUMENTS

| | | | | |
|---|---|---|---|---|
| CN | 108800032 B | * | 7/2022 | B60Q 1/04 |
| EP | 3734146 | | 11/2020 | |

(Continued)

OTHER PUBLICATIONS

International Search Report and Written Opinion dated Aug. 12, 2022 for PCT International Application No. PCT/US2022/028116.

*Primary Examiner* — Anabel Ton
(74) *Attorney, Agent, or Firm* — Volpe Koenig

(57) ABSTRACT

Methods and devices are described. A device includes an optical carrier part and a heatsink bulk part. The optical carrier part has an LED mounting area configured to receive an LED and an alignment feature configured for aligning with an optical component. The heatsink bulk part is separate from the optical carrier part and joined to the optical carrier part, such that the optical carrier part and the heatsink bulk part in conjunction are configured to perform a thermal management of an LED module, including the LED, and the heatsink bulk part, in operation.

14 Claims, 6 Drawing Sheets

(56) References Cited

U.S. PATENT DOCUMENTS

| | | | |
|---|---|---|---|
| 2017/0191624 | A1 | 7/2017 | Crayford et al. |
| 2019/0368707 | A1 | 12/2019 | Kanamori |

FOREIGN PATENT DOCUMENTS

| | | | | |
|---|---|---|---|---|
| EP | 3771861 | | 2/2021 | |
| FR | 3100863 | | 3/2021 | |
| WO | WO-2012007902 | A1 * | 1/2012 | ..... F21S 41/143 |
| WO | WO-2013127632 | A1 * | 9/2013 | ..... F21K 9/60 |

* cited by examiner (a)

(b)

TWO-PART HEATSINK FOR LED MODULE

CROSS REFERENCE TO RELATED APPLICATIONS

This application claims the benefit of U.S. Provisional Patent Application No. 63/185,767, which was filed on May 7, 2021, the contents of which are hereby incorporated by reference herein.

BACKGROUND

Light emitting diodes (LEDs) more and more replace older technology light sources due to superior technical properties, such as energy efficiency and lifetime. This is also true for demanding applications in terms of, for example, luminance, luminosity, and/or beam shaping, such as vehicle headlighting.

SUMMARY

Methods and devices are described. A device includes an optical carrier part and a heatsink bulk part. The optical carrier part has an LED mounting area configured to receive an LED and an alignment feature configured for aligning with an optical component. The heatsink bulk part is separate from the optical carrier part and joined to the optical carrier part, such that the optical carrier part and the heatsink bulk part in conjunction are configured to perform a thermal management of an LED module, including the LED, and the heatsink bulk part, in operation.

BRIEF DESCRIPTION OF THE DRAWINGS

A more detailed understanding can be had from the following description, given by way of example in conjunction with the accompanying drawings wherein.

DETAILED DESCRIPTION

Figure 1:
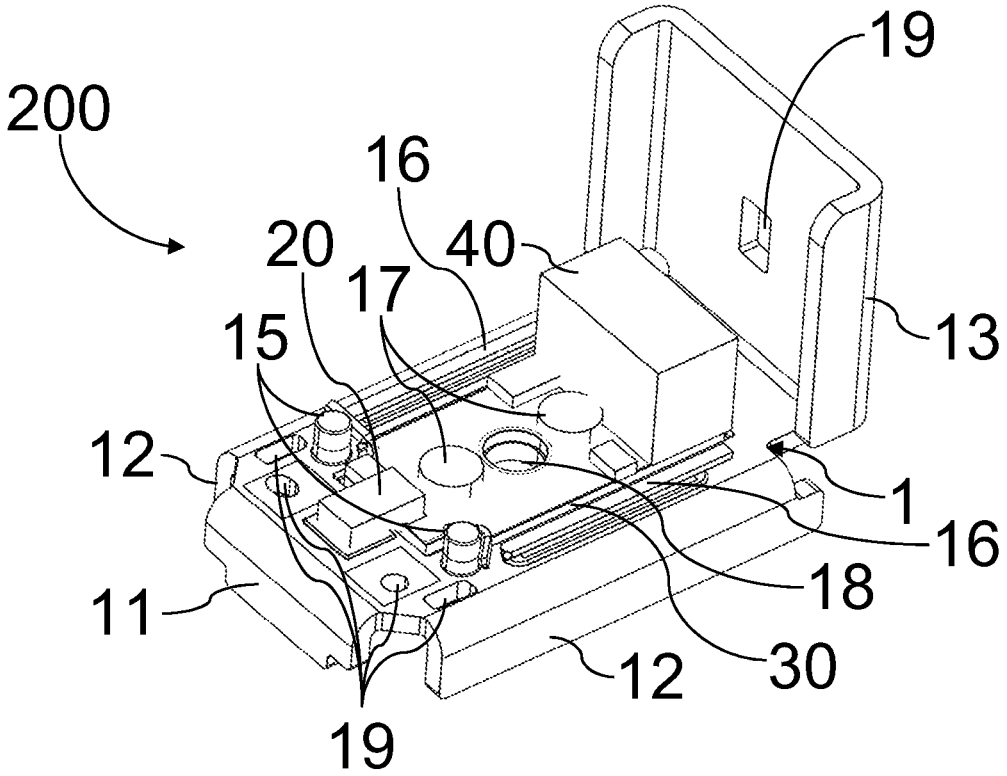
prior art FIG. 1
FIG. 1 is a perspective view of an example LED module.
Figure 1:
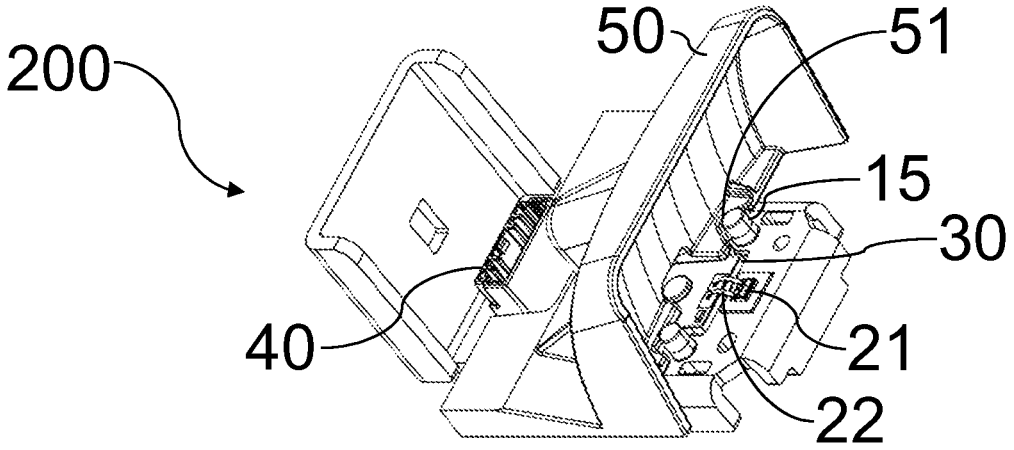
prior art FIG. 1

Examples of different light illumination systems and/or light emitting diode ("LED") implementations will be described more fully hereinafter with reference to the accompanying drawings. These examples are not mutually exclusive, and features found in one example may be combined with features found in one or more other examples to achieve additional implementations. Accordingly, it will be understood that the examples shown in the accompanying drawings are provided for illustrative purposes only and they are not intended to limit the disclosure in any way. Like numbers refer to like elements throughout.

It will be understood that, although the terms first, second, third, etc. may be used herein to describe various elements, these elements should not be limited by these terms. These terms may be used to distinguish one element from another. For example, a first element may be termed a second element and a second element may be termed a first element without departing from the scope of the present invention. As used herein, the term "and/or" may include any and all combinations of one or more of the associated listed items.

It will be understood that when an element such as a layer, region, or substrate is referred to as being "on" or extending "onto" another element, it may be directly on or extend directly onto the other element or intervening elements may also be present. In contrast, when an element is referred to as being "directly on" or extending "directly onto" another element, there may be no intervening elements present. It will also be understood that when an element is referred to as being "connected" or "coupled" to another element, it may be directly connected or coupled to the other element and/or connected or coupled to the other element via one or more intervening elements. In contrast, when an element is referred to as being "directly connected" or "directly coupled" to another element, there are no intervening elements present between the element and the other element. It will be understood that these terms are intended to encompass different orientations of the element in addition to any orientation depicted in the figures.

Relative terms such as "below," "above," "upper,", "lower," "horizontal" or "vertical" may be used herein to describe a relationship of one element, layer, or region to another element, layer, or region as illustrated in the figures. It will be understood that these terms are intended to encompass different orientations of the device in addition to the orientation depicted in the figures.

Despite their energy efficiency, LEDs, such as particular high power LEDs, may still develop considerable heat, which may require cooling, such as by connecting the LED to a heatsink, to keep LED junction temperatures low. Such need for heatsinking LEDs is shared with many other high-power semiconductor components. Although the embodiments are described herein relative to LEDs, the term LED can be used herein to refer to any or all suitable semiconductor light emitting devices, including, for example, diode lasers.

Heatsinks for LED modules may typically fulfill several functions and may also be required to be compliant with various constraints. Firstly, of course, a heatsink has to provide for the thermal management of the LED module when in operation. In other words, the heatsink has to spread the heat generated by operating the LED from the part of the heatsink where the LED is mounted (also referred to herein as the LED mounting area), to the other parts of the heatsink where the heat may finally be transferred to the heatsink's environment.

Such heat spreading may require the heatsink to be made of a material that has high thermal conductivity at and/or near the LED mounting area, such as copper, copper alloys, high-density aluminum, or aluminum alloys, such as produced by extruding aluminum or Al alloys. Parts of the heatsink farther away from the LED mounting area may be made of material of lower thermal conductivity so as to, for example, save material cost and/or allow more flexible manufacturing methods. Thus, for example, less dense aluminum or Al alloys, such as made by die casting, may be used, which may allow richer three-dimensional shapes to be made than achievable by extrusion. Examples of such two-part heatsinks are provided in U.S. Pat. Nos. 8,476,645B2 and 10,914,539B2, which both are hereby incorporated by reference herein.

The heat transfer to the environment may be performed by heat conduction, convection (which may be enhanced by forced convection using, for example, a fan), and radiative heat transfer. All these processes may strongly depend on the size of the heatsink's surface area. Thus, heatsinks for high lumen LED modules may get quite bulky and may very well determine to a large degree the space occupied by the LED module. For the LED module to fit into a limited installation space of a luminaire, often the heatsinks need to be custom made for the specific luminaire. This may be especially true for LED modules for vehicle headlights requiring large lumen packages.

For vehicle headlights, as well as other applications requiring beam shaping, the LEDs of the LED module may need to be aligned to the optical components that process the light emitted by the LEDs in operation. In such applications, the alignment to the first optical component that directly receives the light emitted by the LEDs (e.g., a reflector close to the LEDs) may be particularly sensitive, such as for avoiding glare outside the desired beam profile. Therefore, the LED module may comprise alignment features for such first optical component, and the placement of such alignment features and of the LEDs with respect to such alignment features has to be performed with high precision.

The bulkiness of the heatsinks for LED modules together with the requirement to fit them in a limited installation space may lead to a multitude of complex three-dimensional heatsink shapes specific for each luminaire type. The limited numbers of heatsinks required for each such shape may prevent mass manufacturing, thus increases manufacturing cost. Additionally, complex, 3D shapes may not be able to be processed by standard semiconductor industry machinery. In other words, the LEDs may not be placed by standard SMD pick-and-place robots on such complex 3D objects, which may further increase manufacturing cost. This may be because the optical alignment features of the LED modules and the placement of the LEDs with respect to the alignment features have to be performed with high precision (e.g., on a complex 3D object). Furthermore, the LED modules with the bulky heatsinks may occupy relatively large volumes and may be relatively heavy, thus, increasing shipping costs.

FIG. 1 is a perspective view of an example LED module 200. In the upper part of the drawing labeled (a), the complex shape of heatsink 1 is illustrated with front wings 11, side wings 12, rear wings 13, alignment features 15, 16, fixation features 17, and mounting features 19. An LED block 20 (schematically illustrated only) may be mounted on heatsink 1 and electrically connected to printed circuit board (PCB) 30, which itself may be mounted to heatsink 1 by fixation features 17 (e.g., rivets). PCB 30 may carry electrical connector 40 (schematically illustrated only). Mounting features 19 of heatsink 1 are illustrated as cutouts and may be used to connect the heatsink within a receptacle of a luminaire or for mounting further components to the heatsink. Through-hole 18 in heatsink 1 and PCB 30 may serve for fixing an optical component 50, such as a reflector, to heatsink 1, such as by a screw or rivet penetrating through-hole 18. The reflector may be aligned by touching alignment features 15, 16 of heatsink 1.

Lower part (b) of FIG. 1 shows how carve-outs 51 of reflector 50 may enclose alignment features 15 of heatsink 1 (e.g., cylindrical pins upright protruding from the heatsink's plane or the plane of PCB 30) for alignment within such plane. Transversal to such plane, alignment may be performed by reflector 50 touching the alignment features 16 of heatsink 1, such as planar stripes slightly elevated from the heatsink's plane (not visible in lower part (b)). Lower part (b), which shows the LED module 200 of upper part (a) with reflector 50 added in an about 90° rotated view, shows more detail of electrical connector 40 for electrical connection to the environment of LED module 200, and of LED block 10 with LEDs 21 being electrically connected by ribbon bonds 22 to PCB 30.

The heatsink 1 of FIG. 1 may have the issues discussed above. Its wings 11, 12, 13 may give the heatsink a complex, bulky, and heavy 3D shape. Alignment features 15, 16 may have to be made with high precision, and LEDs 21 may need to be placed with high precision with respect to such alignment features 15, 16. Heatsink 1, with its outstanding wings 11 to 13, may have no planar shape and, thus, may not be compatible with standard semiconductor pick-and-place processes for LED placement (as, for example, usable on PCBs). While heatsink 1 may fit in many luminaires, others may require modifications to the heatsink 1, such as different extensions or angles to the heatsink plane of wings 11, 12, and in particular of the rear wing 13. This may compromise economy of scale with mass manufacturing of such heatsinks.

Embodiments described herein may provide for splitting a heatsink into two parts and selecting which components to locate on each of the two parts based on degree of precision required in manufacturing. Accordingly, in embodiments described herein, a two part heatsink may be provided that includes a high-precision part and a less precise part. This may enable portions of a heatsink to be manufactured with high precision while making manufacturing of parts that do not require as much precision more efficient, by reducing the complexity of the manufacturing processes, and thereby reducing time and expense involved in manufacturing the heatsinks.

Figure 2:
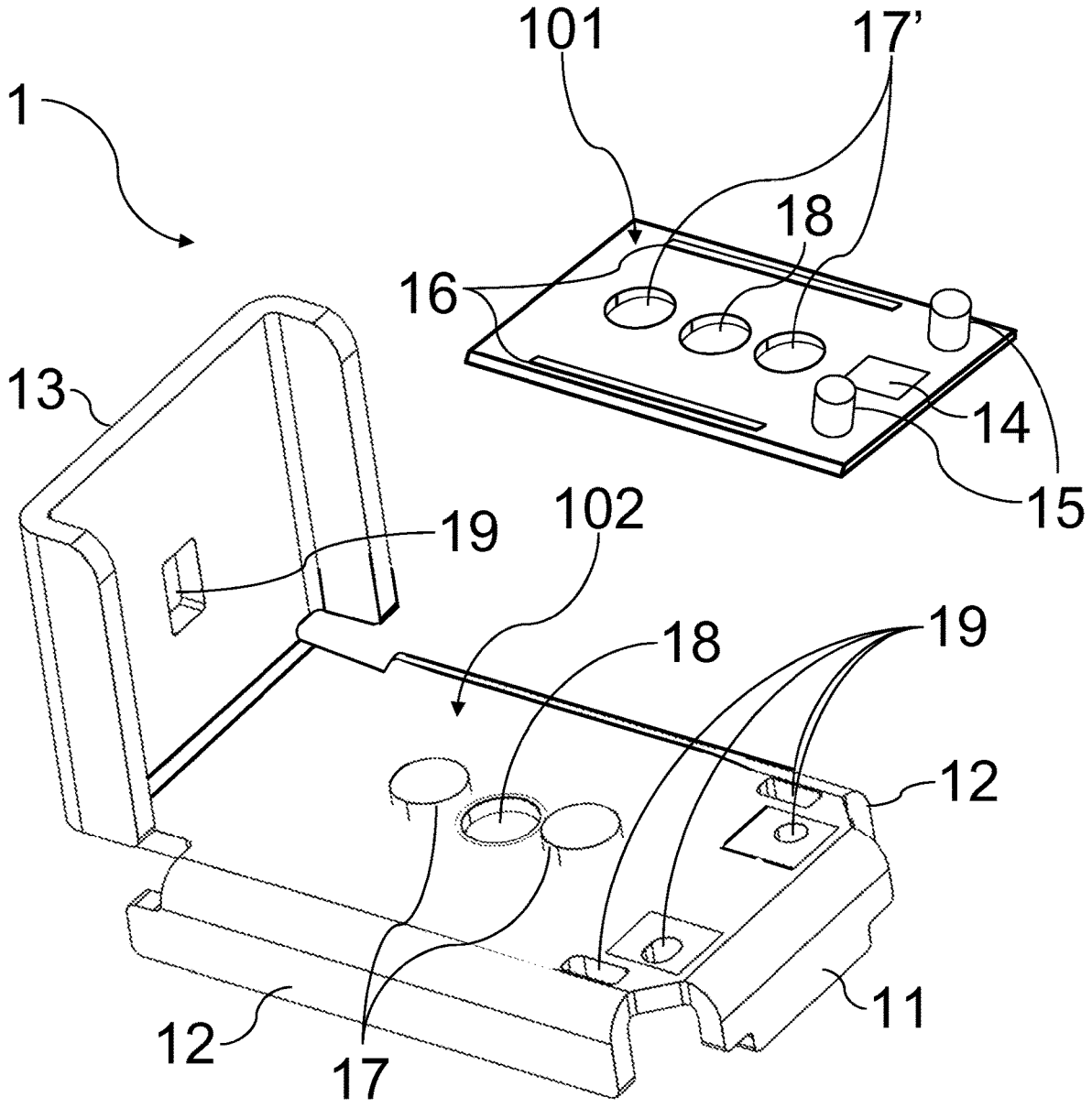
FIG. 2 is a perspective view of an example two-part heatsink.

FIG. 2 is a perspective view of an example two-part heatsink 1. In the example illustrated in FIG. 2, the two-part heatsink 1 includes an optical carrier part 101 and a heatsink bulk part 102. The optical carrier part 101 may be a high-precision optical carrier part, which may comprise at least an LED mounting area 14 and alignment features 15, 16 for an optical component processing light emitted by an LED placed in the LED mounting area 14. Manufacturing such alignment features 15, 16 and mounting the LED on LED mounting area 14 with respect to such alignment features 15, 16 has to be performed with high precision. Other parts of the optical carrier part 101, however, may not require as much precision but may still be provided on the optical carrier part 101. In the embodiment of FIG. 2, for example, through-holes 17' corresponding to the PCB fixation features 17 of the heatsink bulk part 102 and through-hole 18 corresponding to the respective through-holes in the heatsink bulk part and the PCB may be needed or desired (e.g., for coupling the two parts of the heatsink together) although they may not require any particular precision on manufacturing.

The heatsink bulk part 102 may be a less precise heatsink bulk part. The bulk heatsink part 102 may need only low precision in manufacturing as it may not carry any optically relevant parts. In other words, the LED or LEDs and the optical components may all be mounted to optical carrier part 101. The bulk heatsink part 102 may only carry features requiring low precision, such as, in FIG. 2, heatsink wings 11 to 13, PCB fixation features 17, through-hole 18 (for reflector fixation), and heatsink mounting features 19.

The thermal requirements on the optical carrier part 101 itself may not be particularly demanding at least because the optical carrier part 101 and the heatsink bulk part 102 may be joined together before LEDs mounted in the LED mounting area 14 will be operational and, therefore, the two heatsink parts, optical carrier part 101 and heatsink bulk part 102, may, in conjunction, provide the necessary heat dissipation for the LEDs. Typically, the connection between optical carrier part 101 and heatsink bulk part 102 should have a low thermal resistance, and it may be advantageous to choose a high thermal conductivity material for the optical carrier part 101 to provide a sufficient heat spreading function for the LEDs. Such connection may be performed by screwing, riveting, crimping or any other mechanical fixation where a thermal grease may be added as interface material to lower thermal resistance in case of imperfectly smooth surfaces otherwise limiting the contact area between the heatsink parts. However, joining may also be performed by gluing, or heatsink bulk part 102 might be overmolded to parts of optical carrier part 101. Details for such overmolding are described in U.S. Pat. No. 10,914,539, which was incorporated by reference herein above.

In embodiments, the optical carrier part 101 may have a plate-like shape, as shown in an example in FIG. 2. Using such planar base shape may, on one hand, ease manufacturing, such as by shaping the alignment features 15, 16 as elevations from the plate, which might be performed, for example, by stamping or deep drawing after starting from a sheet metal as planar base shape. Such planar base shape, on the other hand, might also allow using standard SMD placement technology (e.g., fiducial markings on the alignment features 15, 16 and pick-and-place machines, for precise LED placement versus alignment features 15, 16).

For thermal reasons, such as described above, the optical alignment part 101 may mainly consist of a good thermal conductivity material like metal, and, in particular, copper or extruded aluminum. Thermal management may be further improved by applying surface layers to a core material of the optical alignment part 101 (but also to a core material of the heatsink bulk part 102) with high emissivity to improve radiative heat transfer to the environment of heatsink 1. Potential techniques for applying such surface layers may include, for example, anodizing heatsinks made of aluminum. Such anodization layers may be electrically insulating, which may allow placing electrically conducting traces immediately on the anodization layer. This might even render a PCB superfluous if the complete electrical circuit pattern is applied on the anodization layer. Instead of an anodization layer, any electrically insulating layer applied by a coating technique, may be used. However, such circuitry may also be placed on a PCB mounted on the optical carrier part 101, which PCB, like in FIG. 1, may then carry the electrical connector for the external power supply.

Figure 3:
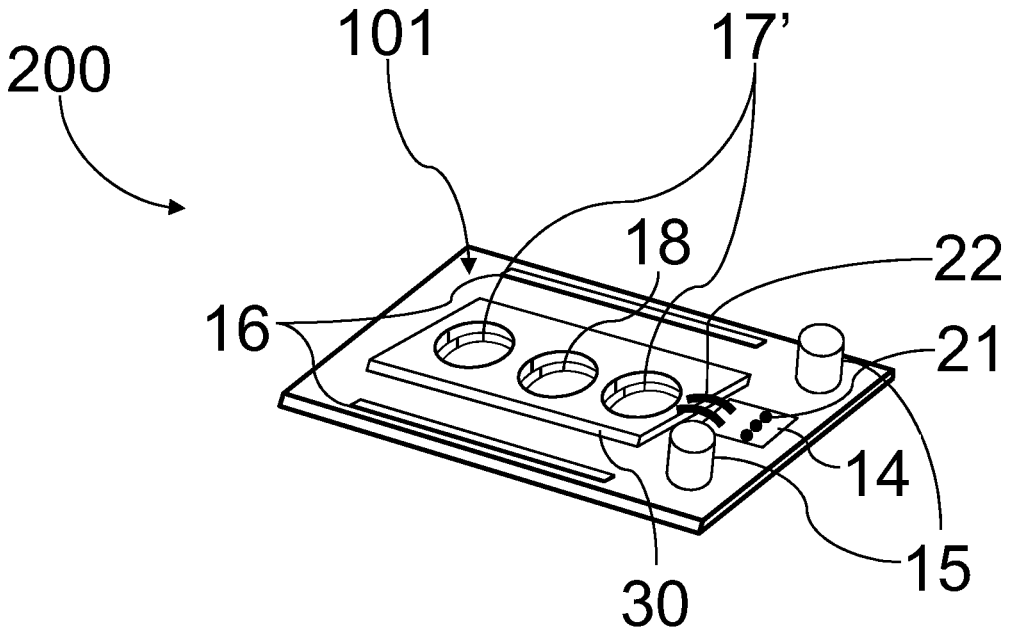
FIG. 3 is a perspective view of an LED module comprising the optical alignment part of FIG. 2 with a PCB mounted thereupon and LEDs mounted in the LED mounting area and electrically connected to PCB by ribbon bonds.

FIG. 3 is a perspective view of an LED module 200 comprising the optical alignment part 101 of FIG. 2 with a PCB 30 mounted thereupon and LEDs 21 mounted in the LED mounting area 14 and electrically connected to PCB 30 by ribbon bonds 22. In FIG. 3, reference signs 17' and 18 have been kept for the through-holes, which, in FIG. 3, also extend not just through both the optical carrier part 101 and PCB 30.

Splitting a heatsink, as described herein, into a high-precision part and a low-precision part may offer further advantages as to a building block system. For example, while the optical carrier part might mostly depend on the optical setup of the luminaire as, for example, a vehicle headlight, the larger volume occupying bulk heatsink part might mostly depend on the housing shape of the luminaire, as, for example, determined from vehicle body design considerations. Thus, it might be advantageous to design a collection of different optical carrier parts according to various optical systems used in the market, for example, according to the various reflector and lens designs of reflection and projection vehicle headlights and a collection of different heatsink bulk parts according to the various luminaire housing shapes in the market, for example according to the various car body shapes. These design procedures may to some or even to a large extent be independent from each other. Combining a representative of the optical alignment part collection with a representative of the heatsink bulk part collection, by the large number of possible combinations, may allow equipping a much larger set of luminaires with an appropriate heatsink according to the disclosure than there are single heatsink parts in the two collections. Compared to a customized design of a single-part heatsink for each luminaire type, this might yield a considerable cost advantage in not just saving design time but also allowing taking profit of mass manufacturing techniques. Additionally, savings in logistics, such as shipment cost, may be realizable by having the manufacturing sites of the various parts close to their final assembly sites. However, it may prove useful to concentrate manufacture of the relatively small size and low weight optical alignment parts in a few factories only. In other words, accepting relatively large transport distances as transport of such small and light parts may be cheap, and cost savings due to economy of scale in mass manufacturing may prevail. On the other hand, manufacturing the large and heavy heatsink bulk parts close to the final assembly sites (e.g., local-for-local manufacture) may allow trading-off cost of transportation against cost of manufacture.

Figure 4:
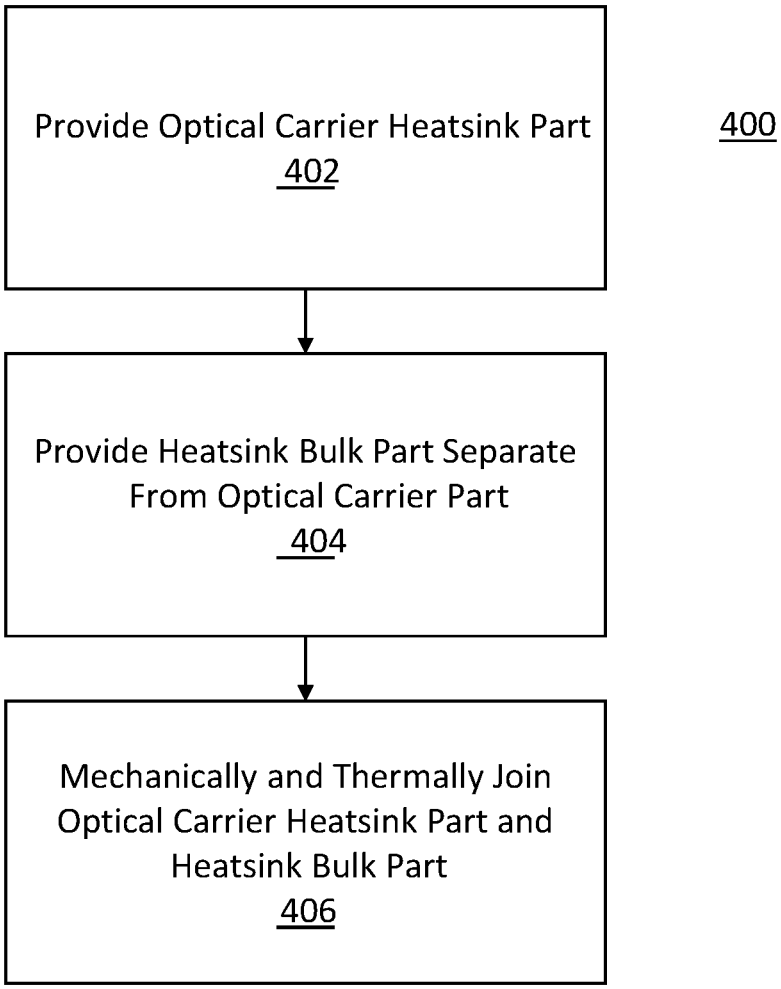
FIG. 4 is a flow diagram of an example method of manufacturing a two part heatsink.

FIG. 4 is a flow diagram of an example method 400 of manufacturing a two part heatsink. In the example illustrated in FIG. 4, the method includes providing an optical carrier heatsink part (402). The optical carrier heatsink part may include an LED mounting area and an alignment feature configured for aligning with an optical component. A heatsink bulk part may also be provided that is separate from the optical carrier part (404). The optical carrier heatsink part and the heatsink bulk part may be mechanically and thermally joined (406). The optical carrier heatsink part and the heatsink bulk part in conjunction may be configured to perform a thermal management of an LED module, including the LED, and the heatsink bulk part, in operation.

In some embodiments, the optical carrier heatsink part and the heatsink bulk part may be mechanically and thermally joined by one or more of screwing, riveting, crimping, gluing, or overmolding the heatsink bulk part to the optical carrier part. In some embodiments, the optical carrier heatsink part may be selected from a collection of different optical carrier heatsink parts. In some embodiments, the heatsink bulk part may be selected from a collection of different heatsink bulk parts.

Figure 5:
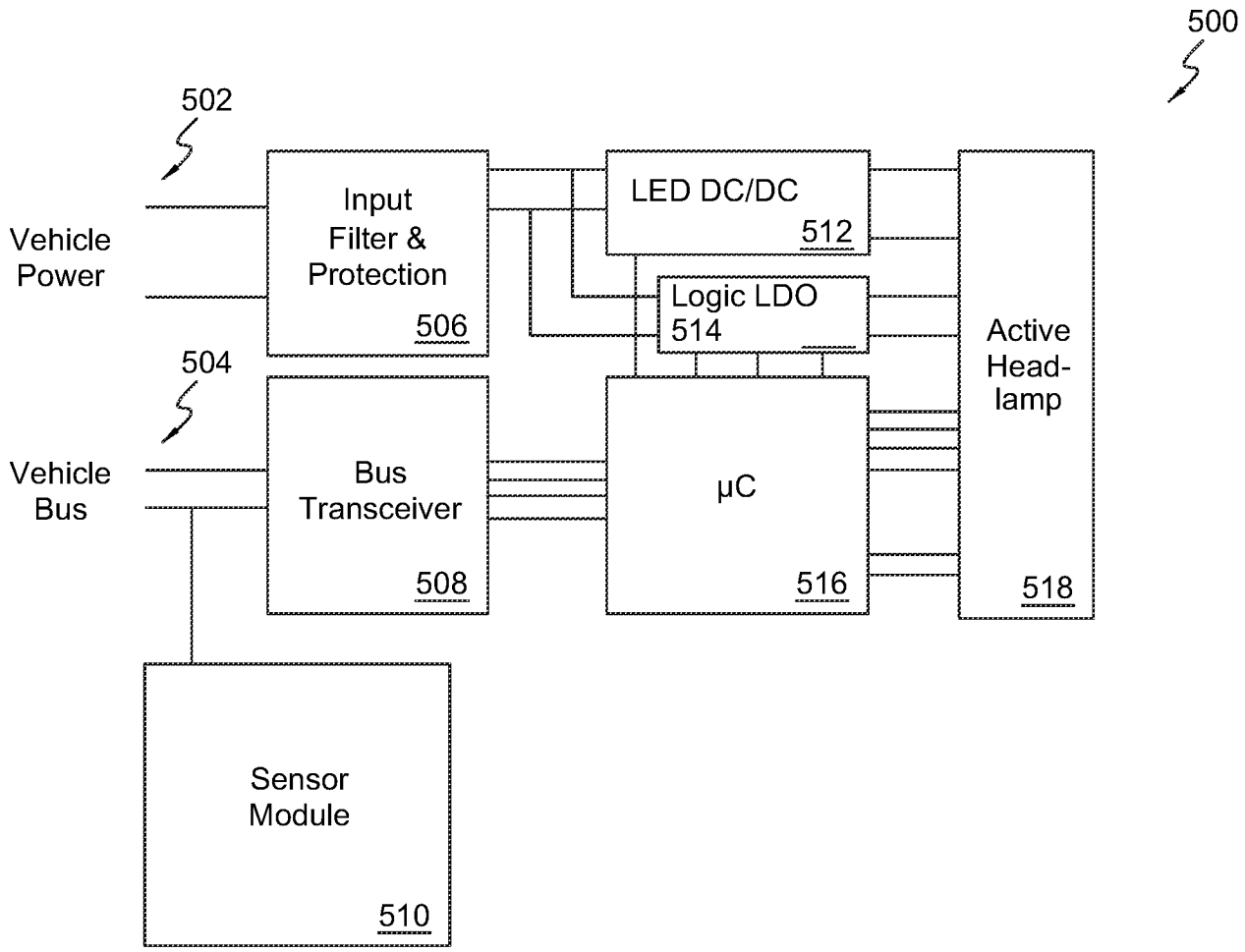
FIG. 5 is a diagram of an example vehicle headlamp system.

FIG. 5 is a diagram of an example vehicle headlamp system 500 that may incorporate one or more of the embodiments and examples described herein. The example vehicle headlamp system 500 illustrated in FIG. 5 includes power lines 502, a data bus 504, an input filter and protection module 506, a bus transceiver 508, a sensor module 510, an LED direct current to direct current (DC/DC) module 512, a logic low-dropout (LDO) module 514, a micro-controller 516 and an active head lamp 518.

The power lines 502 may have inputs that receive power from a vehicle, and the data bus 504 may have inputs/outputs over which data may be exchanged between the vehicle and the vehicle headlamp system 500. For example, the vehicle headlamp system 500 may receive instructions from other locations in the vehicle, such as instructions to turn on turn signaling or turn on headlamps, and may send feedback to other locations in the vehicle if desired. The sensor module 510 may be communicatively coupled to the data bus 504 and may provide additional data to the vehicle headlamp system 500 or other locations in the vehicle related to, for example, environmental conditions (e.g., time of day, rain, fog, or ambient light levels), vehicle state (e.g., parked, in-motion, speed of motion, or direction of motion), and presence/position of other objects (e.g., vehicles or pedestrians). A headlamp controller that is separate from any vehicle controller communicatively coupled to the vehicle data bus may also be included in the vehicle headlamp system 500. In FIG. 5, the headlamp controller may be a micro-controller, such as micro-controller (pc) 516. The micro-controller 516 may be communicatively coupled to the data bus 504.

The input filter and protection module 706 may be electrically coupled to the power lines 502 and may, for example, support various filters to reduce conducted emissions and provide power immunity. Additionally, the input filter and protection module 506 may provide electrostatic discharge (ESD) protection, load-dump protection, alternator field decay protection, and/or reverse polarity protection.

The LED DC/DC module 512 may be coupled between the input filter and protection module 106 and the active headlamp 518 to receive filtered power and provide a drive current to power LEDs in the LED array in the active headlamp 518. The LED DC/DC module 512 may have an input voltage between 7 and 18 volts with a nominal voltage of approximately 13.2 volts and an output voltage that may be slightly higher (e.g., 0.3 volts) than a maximum voltage for the LED array (e.g., as determined by factor or local calibration and operating condition adjustments due to load, temperature or other factors).

The logic LDO module 514 may be coupled to the input filter and protection module 506 to receive the filtered power. The logic LDO module 514 may also be coupled to the micro-controller 516 and the active headlamp 518 to provide power to the micro-controller 516 and/or electronics in the active headlamp 518, such as CMOS logic.

The bus transceiver 508 may have, for example, a universal asynchronous receiver transmitter (UART) or serial peripheral interface (SPI) interface and may be coupled to the micro-controller 516. The micro-controller 516 may translate vehicle input based on, or including, data from the sensor module 710. The translated vehicle input may include a video signal that is transferrable to an image buffer in the active headlamp 518. In addition, the micro-controller 516 may load default image frames and test for open/short pixels during startup. In embodiments, an SPI interface may load an image buffer in CMOS. Image frames may be full frame, differential or partial frames. Other features of micro-controller 516 may include control interface monitoring of CMOS status, including die temperature, as well as logic LDO output. In embodiments, LED DC/DC output may be dynamically controlled to minimize headroom. In addition to providing image frame data, other headlamp functions, such as complementary use in conjunction with side marker or turn signal lights, and/or activation of daytime running lights, may also be controlled.

Figure 6:
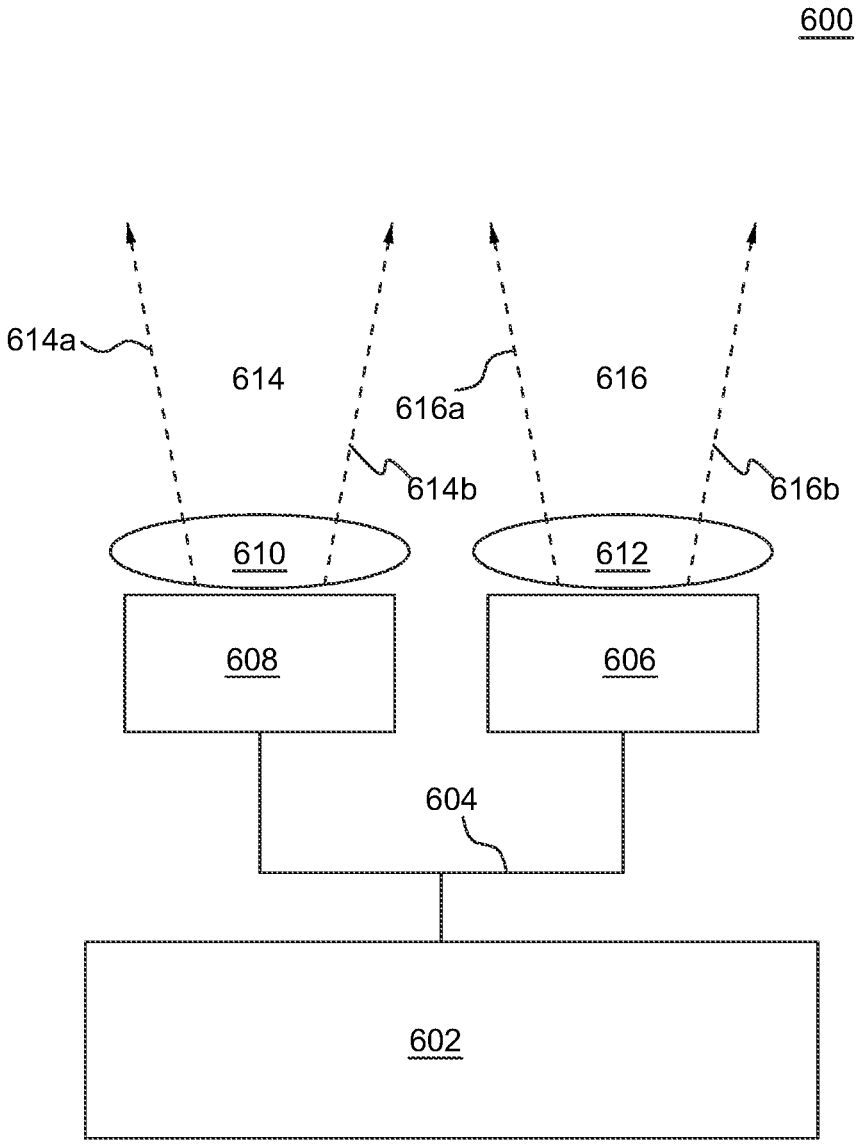
FIG. 6 is a diagram of another example vehicle headlamp system.

FIG. 6 is a diagram of another example vehicle headlamp system 600. The example vehicle headlamp system 600 illustrated in FIG. 6 includes an application platform 602, two LED lighting systems 606 and 608, and secondary optics 610 and 612.

The LED lighting system 608 may emit light beams 614 (shown between arrows 614*a* and 614*b* in FIG. 6). The LED lighting system 606 may emit light beams 616 (shown between arrows 616*a* and 616*b* in FIG. 6). In the embodiment shown in FIG. 6, a secondary optic 610 is adjacent the LED lighting system 608, and the light emitted from the LED lighting system 608 passes through the secondary optic 610. Similarly, a secondary optic 612 is adjacent the LED lighting system 606, and the light emitted from the LED lighting system 606 passes through the secondary optic 612. In alternative embodiments, no secondary optics 610/612 are provided in the vehicle headlamp system.

Where included, the secondary optics 610/612 may be or include one or more light guides. The one or more light guides may be edge lit or may have an interior opening that defines an interior edge of the light guide. LED lighting systems 608 and 606 may be inserted in the interior openings of the one or more light guides such that they inject light into the interior edge (interior opening light guide) or exterior edge (edge lit light guide) of the one or more light guides. In embodiments, the one or more light guides may shape the light emitted by the LED lighting systems 608 and 606 in a desired manner, such as, for example, with a gradient, a chamfered distribution, a narrow distribution, a wide distribution, or an angular distribution.

The application platform 602 may provide power and/or data to the LED lighting systems 606 and/or 608 via lines 604, which may include one or more or a portion of the power lines 502 and the data bus 504 of FIG. 5. One or more sensors (which may be the sensors in the vehicle headlamp system 600 or other additional sensors) may be internal or external to the housing of the application platform 602. Alternatively, or in addition, as shown in the example vehicle headlamp system 500 of FIG. 5, each LED lighting system 608 and 606 may include its own sensor module, connectivity and control module, power module, and/or LED array.

In embodiments, the vehicle headlamp system 600 may represent an automobile with steerable light beams where LEDs may be selectively activated to provide steerable light. For example, an array of LEDs or emitters may be used to define or project a shape or pattern or illuminate only selected sections of a roadway. In an example embodiment, infrared cameras or detector pixels within LED lighting systems 606 and 608 may be sensors (e.g., similar to sensors in the sensor module 510 of FIG. 5) that identify portions of a scene (e.g., roadway or pedestrian crossing) that require illumination.

Having described the embodiments in detail, those skilled in the art will appreciate that, given the present description, modifications may be made to the embodiments described herein without departing from the spirit of the inventive concept. Therefore, it is not intended that the scope of the invention be limited to the specific embodiments illustrated and described.

What is claimed is:

1. A device comprising:

an optical carrier part comprising:

a single, plate-like sheet of thermally conductive material, an LED mounting area on the single, plate-like sheet configured to receive an LED, and an alignment feature protruding from the single-plate-like sheet and configured for aligning with an optical component; and a heatsink bulk part, separate from the optical carrier part and joined to the optical carrier part, such that the optical carrier part and the heatsink bulk part in conjunction are configured to perform a thermal management of an LED module, including the LED, and the heatsink bulk part, in operation.

2. The device according to claim 1, wherein the heatsink bulk part is joined to the optical carrier part by one or more of a screw, or rivet, crimping, glue, or an overmolding of the heatsink bulk part to the optical carrier part.

3. A device comprising:

an optical carrier part comprising:

a metal plate, an electrically insulating layer on the metal plate, electrical traces, on the electrically insulating layer, configured to provide power to an LED, an LED mounting area configured to receive the LED, an alignment feature configured for aligning with an optical component, and at least one mechanical connector configured for mechanical and thermal coupling with a heatsink bulk part to complete a thermal management of an LED module, including the LED, in operation.

4. The device according to claim 3, wherein the optical carrier part further comprises an electrical connector mounted on the PCB and configured to receive an external plug, wherein the electrical traces electrically couple the LED to the electrical connector.

5. The device according to claim 3, wherein the optical carrier part is plate like.

6. The device of claim 3, further comprising an LED mounted on the LED mounting area.

7. The device according to claim 6, further comprising the heatsink bulk part, wherein the heatsink bulk part separate from the optical carrier part and joined to the optical carrier part, such that the optical carrier part and the heatsink bulk part in conjunction are configured to perform a thermal management of an LED module, including the LED, and the heatsink bulk part, in operation.

8. The device according to claim 7, wherein the heatsink bulk part further comprises mounting features configured for mounting the LED module to a receptacle of a luminaire.

9. The device according to claim 7, wherein the heatsink bulk part is joined to the optical carrier part by one or more of a screw, or rivet, crimping, glue, or an overmolding of the heatsink bulk part to the optical carrier part.

10. A method of manufacturing an LED module, the method comprising:

providing an optical carrier heatsink part comprising an LED mounting area on a single, plate-like sheet of thermally conductive material and an alignment feature protruding from the single, plate-like sheet and configured for aligning with an optical component;

providing a heatsink bulk part that is separate from the optical carrier part; and mechanically and thermally joining the optical carrier heatsink part and the heatsink bulk part such that the optical carrier part and the heatsink bulk part in conjunction are configured to perform a thermal management of an LED module, including the LED, and the heatsink bulk part, in operation.

11. The method of claim 10, wherein the mechanically and thermally joining further comprises one or more of screwing, riveting, crimping, gluing, or overmolding the heatsink bulk part to the optical carrier part.

12. The method of claim 10, wherein the providing the optical carrier heatsink part comprises selecting the optical carrier heatsink part from a collection of different optical carrier heatsink parts.

13. The method of claim 10, wherein the providing the heatsink bulk part comprises selecting the heatsink bulk part from a collection of different heatsink bulk parts.

14. The method of claim 10, further comprising mounting an LED to the LED mounting area of the optical carrier heatsink part.

* * * * *